US009808958B1

(12) United States Patent
Cuburu

(10) Patent No.: US 9,808,958 B1
(45) Date of Patent: Nov. 7, 2017

(54) POST MOLDING SYSTEM

(71) Applicant: Jean Leon Cuburu, San Bruno, CA (US)

(72) Inventor: Jean Leon Cuburu, San Bruno, CA (US)

( * ) Notice: Subject to any disclaimer, the term of this patent is extended or adjusted under 35 U.S.C. 154(b) by 0 days.

(21) Appl. No.: 15/296,122

(22) Filed: Oct. 18, 2016

(51) Int. Cl.
*B28B 7/18* (2006.01)
*E04H 17/14* (2006.01)

(52) U.S. Cl.
CPC ..... *B28B 7/183* (2013.01); *B28B 7/18* (2013.01); *E04H 17/14* (2013.01)

(58) Field of Classification Search
CPC ..... B28B 7/183; B28B 7/18
USPC ..... 249/142, 143
See application file for complete search history.

(56) References Cited

U.S. PATENT DOCUMENTS 780,321 A * 1/1905 Burkholder et al. ... E04G 13/02 249/143
834,448 A * 10/1906 Brooks ..... B28B 7/18 249/143
838,737 A * 12/1906 Moore ..... B28B 21/566 249/143
887,206 A * 5/1908 Logan ..... B28B 21/566 249/143
887,498 A 5/1908 McElhinney
889,091 A * 5/1908 Ballinger ..... B29C 45/33 249/143
907,494 A * 12/1908 Harding et al. ..... B28B 7/18 249/143
911,584 A 2/1909 Ford
949,091 A * 2/1910 Roop ..... B28B 21/566 249/143
975,135 A * 11/1910 Kelsey et al. ..... B28B 7/18 249/143
986,957 A * 3/1911 Wallin ..... E04G 13/02 249/143
996,983 A * 7/1911 Granstrom ..... B28B 7/18 249/143
1,186,662 A 6/1916 Kirkwood
1,298,341 A * 3/1919 Henkle ..... E04G 13/02 249/143
1,323,689 A * 12/1919 Granger et al. ..... B28B 7/18 249/112
1,645,776 A * 10/1927 Sanson ..... B28B 7/0044 249/104
1,911,720 A * 5/1933 Sherman ..... B28B 1/008 249/103
2,060,246 A * 11/1936 Russell ..... B28B 7/02 249/115
2,480,899 A * 9/1949 Bond ..... B22C 9/06 164/340

(Continued)

OTHER PUBLICATIONS

"Concrete Problems"; Earle R. Bridge. The Industrial Arts Magazine (vols. I-II), 1914—pp. 172-174. The Bruce Publishing Company.*

*Primary Examiner* — Michael Safavi

(57) ABSTRACT

A post molding system includes a box. Concrete is poured into the box such that the concrete is formed in the shape of the box. A cage is provided and the cage is positioned in the box. The cage reinforces the concrete when the concrete dries in the box. A pair of molds is provided. Each of the molds is positioned on the box when the concrete is poured into the box. Thus, each of the molds forms an aperture extending through the concrete.

4 Claims, 6 Drawing Sheets

(56) References Cited

U.S. PATENT DOCUMENTS

| | | | | | |
|---|---|---|---|---|---|
| 2,578,165 | A | * | 12/1951 | Bailey | E04H 17/06 249/143 |
| 2,917,802 | A | * | 12/1959 | Nicholson | B28B 7/18 249/143 |
| 3,012,284 | A | * | 12/1961 | Touhey, Jr. | B29C 44/38 249/142 |
| 3,084,909 | A | * | 4/1963 | Carr | E04C 5/08 249/142 |
| 3,190,607 | A | * | 6/1965 | Sonneville | B28B 7/183 238/115 |
| 4,552,716 | A | * | 11/1985 | Habich | B41J 2/25 249/142 |
| 4,824,077 | A | | 4/1989 | Brickner | |
| 4,831,802 | A | * | 5/1989 | Cromrich | B28B 1/008 52/311.1 |
| 4,963,305 | A | * | 10/1990 | Cromrich | B28B 1/008 264/43 |
| 5,397,228 | A | * | 3/1995 | Metten | B28B 1/44 264/156 |
| 5,580,480 | A | * | 12/1996 | Chatelain | E04H 17/20 249/143 |
| D395,712 | S | | 6/1998 | Orton et al. | |
| 6,684,477 | B2 | | 2/2004 | Crissey | |
| 2009/0313912 | A1 | | 12/2009 | Perry | |

* cited by examiner

POST MOLDING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to molding devices and more particularly pertains to a new molding device for forming concrete fence posts.

BRIEF SUMMARY OF THE INVENTION

An embodiment of the disclosure meets the needs presented above by generally comprising a box. Concrete is poured into the box such that the concrete is formed in the shape of the box. A cage is provided and the cage is positioned in the box. The cage reinforces the concrete when the concrete dries in the box. A pair of molds is provided. Each of the molds is positioned on the box when the concrete is poured into the box. Thus, each of the molds forms an aperture extending through the concrete.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
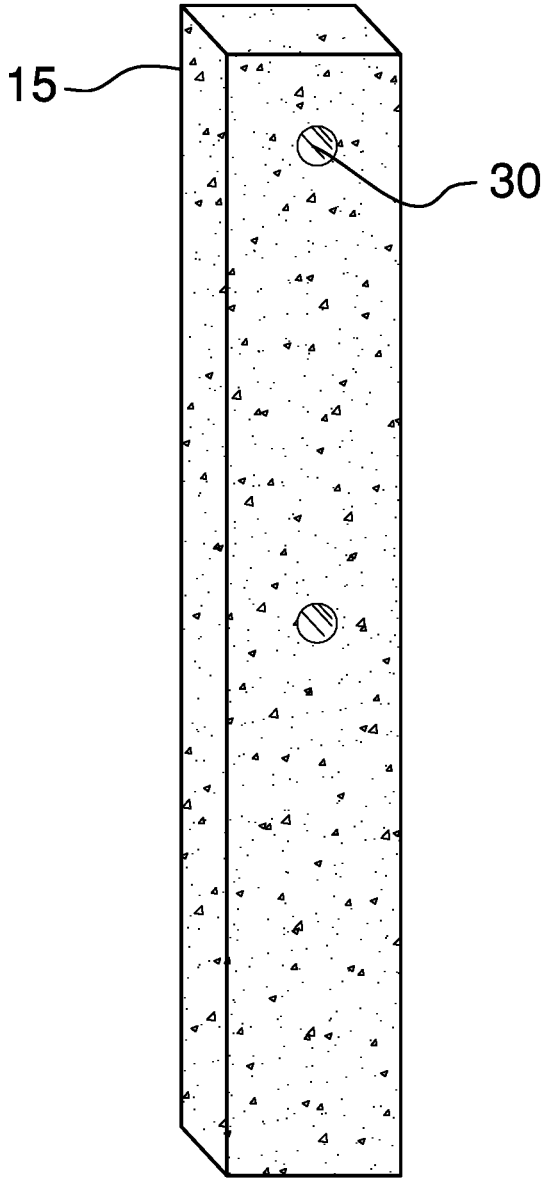
FIG. 1 is a perspective view of a rectangular stanchion of a post molding system according to an embodiment of the disclosure.
Figure 2:
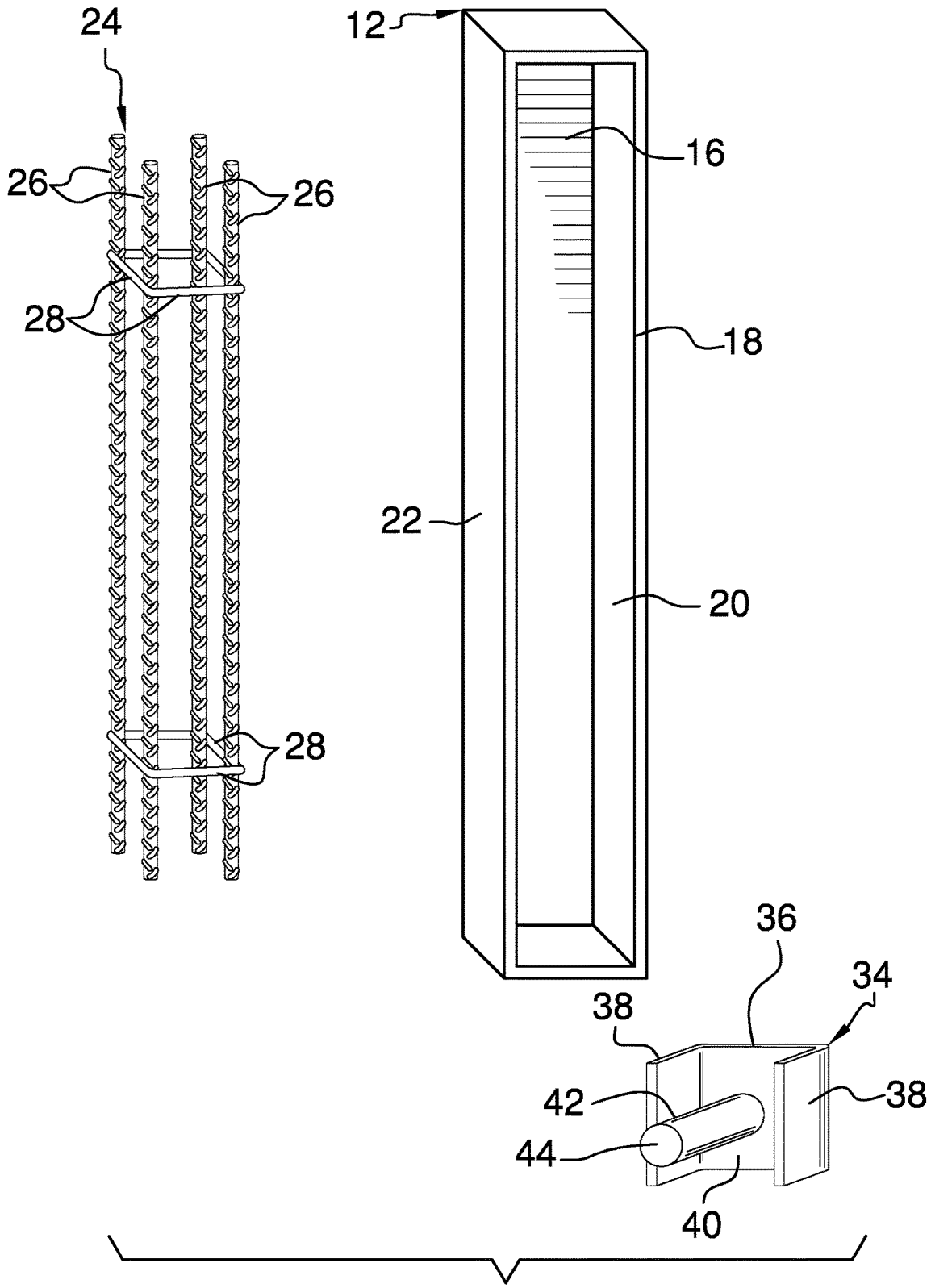
FIG. 2 is a perspective view of an embodiment of the disclosure.
Figure 3:
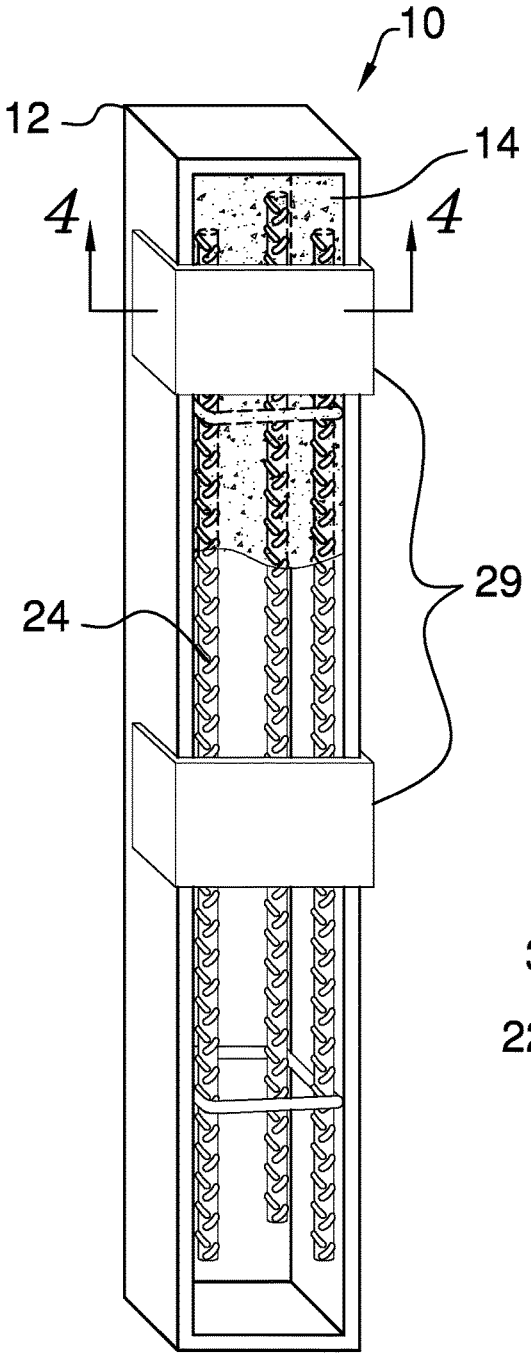
FIG. 3 is a front perspective view of an embodiment of the disclosure.
Figure 4:
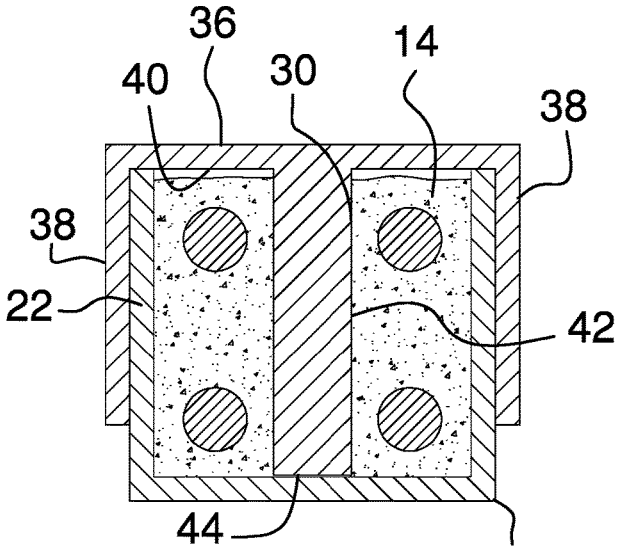
FIG. 4 is a cross sectional view taken along line 4-4 of FIG. 5 of an embodiment of the disclosure.
Figure 5:
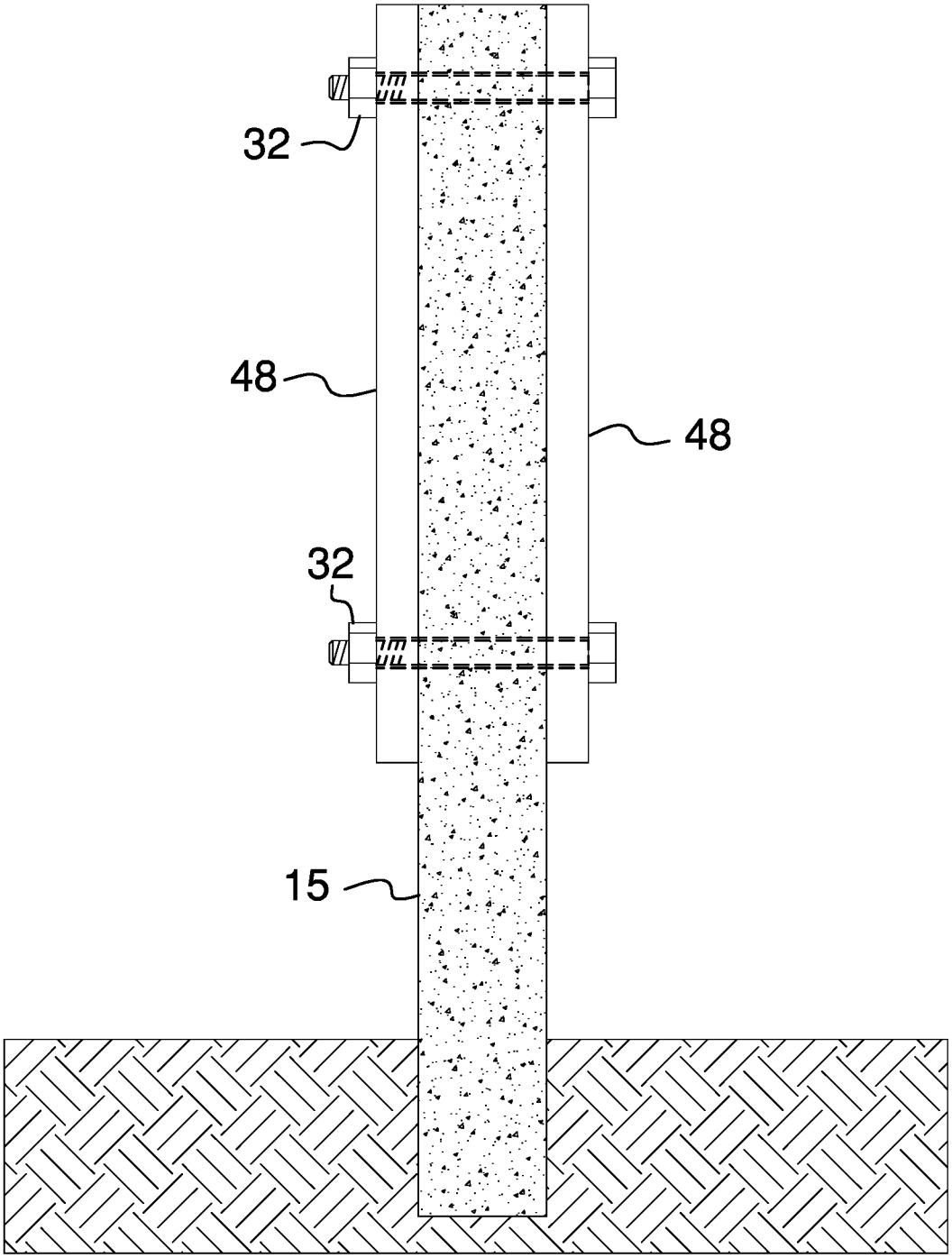
FIG. 5 is a perspective in-use view of an embodiment of the disclosure.
Figure 6:
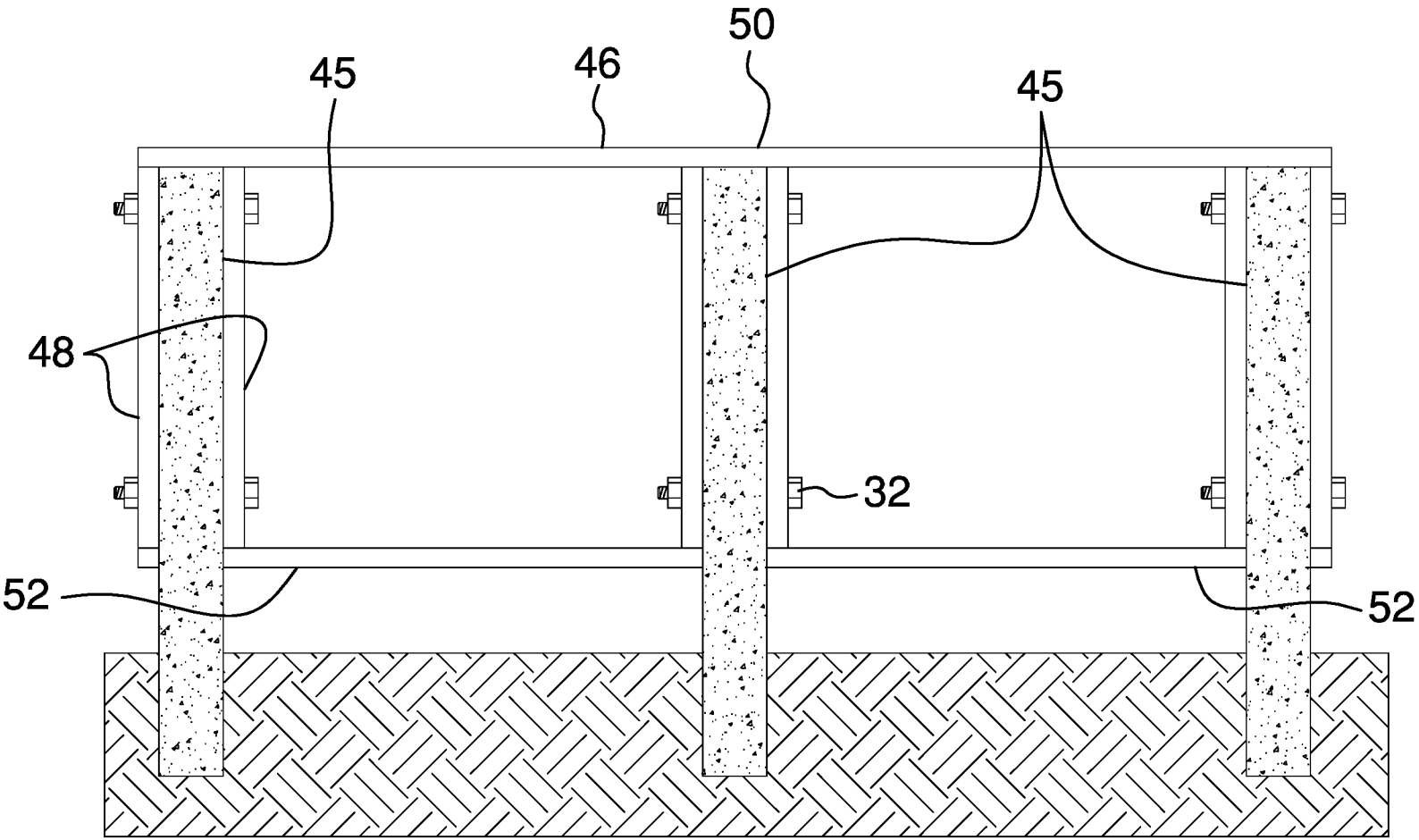
FIG. 6 is a back perspective in-use view of an embodiment of the disclosure.
Figure 7:
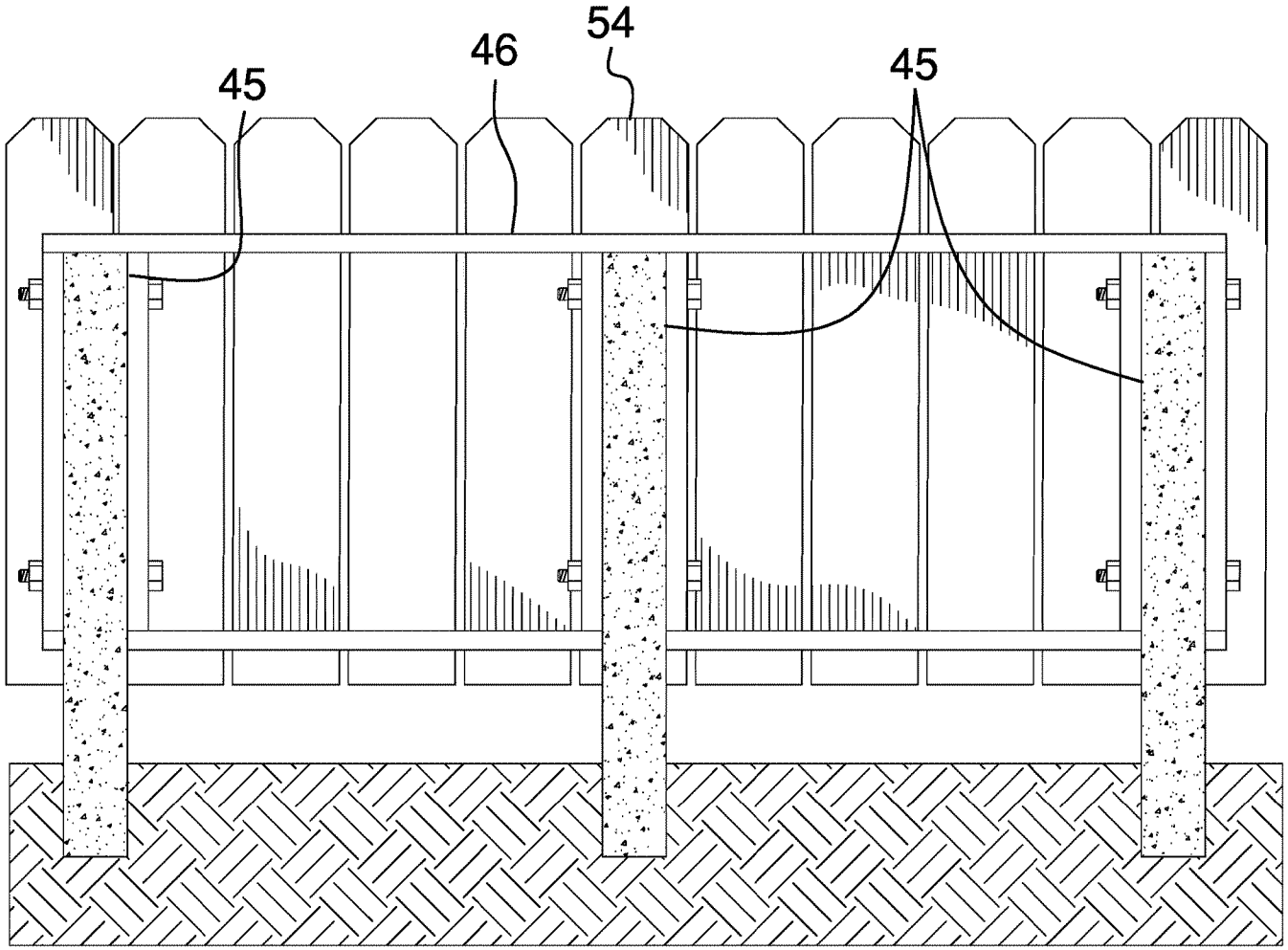
FIG. 7 is a rear-perspective in-use view of an embodiment of the disclosure.

With reference now to the drawings, and in particular to FIGS. 1 through 7 thereof, a new molding device embodying the principles and concepts of an embodiment of the disclosure and generally designated by the reference numeral 10 will be described.

As best illustrated in FIGS. 1 through 7, the post molding system 10 generally comprises a box 12 having concrete 14 being poured therein. Thus, the concrete 14 is formed into the shape of a rectangular stanchion 15. The concrete 14 may comprise Portland cement or the like. The box 12 has back wall 16, a top side 18, an interior surface 20 and an outside surface 22. The top side 18 is open such that the concrete 14 is poured into the top side 18. The box 12 may have a length ranging between one meter and two meters. Moreover, the box 12 may have a depth and a width ranging between ten cm and fifteen cm.

A cage 24 is provided and the cage 24 is positioned in the box 12. The cage 24 reinforces the concrete 14 when the concrete 14 dries in the box 12. The cage 24 comprises a plurality of first members 26. Each of the first members 26 may be rebar or the like. A plurality of second members 28 is provided. Each of the second members 28 is coupled between the first members 26 such that the first members 26 are spaced apart from each other. The first members 26 are arranged to form four corners of a rectangle.

A pair of molds 29 is provided. Each of the molds 29 is positioned on the box 12 when the concrete 14 is poured into the box 12. Each of the molds 29 forms an aperture 30 extending through the concrete 14. Thus, a fastener 32 may be extended through the aperture 30. The fastener 32 may be a bolt or the like.

Each of the molds 29 comprises a bracket 34 that has a central panel 36 extending between a pair of lateral panels 38. The lateral panels 38 are spaced apart from each other such that the bracket 34 has a U-shape. The bracket 34 has an inside surface 40. The inside surface 40 corresponding to each of the lateral panels 38 abuts the outside surface 22 of the box 12 when the bracket 34 is positioned on the box 12. The inside surface 40 corresponding to the central panel 36 abuts the top side 18 of the box 12.

A shaft 42 is coupled to and extends away from the inside surface 40 corresponding to the central panel 36. The shaft 42 is centrally positioned between the lateral panels 38. The shaft 42 has a distal end 44 with respect to the central panel 36. The distal end 44 abuts the interior surface 20 of the back wall 16 when the bracket 34 is positioned on the box 12. Thus, the shaft 42 forms the aperture 30 extending through the concrete 14 when the concrete 14 is poured into the box 12.

A plurality of the rectangular stanchions 45 is formed. A framework 46 is provided and the framework 46 is coupled to the rectangular stanchions 45. The framework 46 may include a pair of upright members 48. Each of the upright members 48 is coupled on opposite sides of the rectangular stanchions 45. A pair of the fasteners 32 extends through each of the upright members 48. Thus, each of the upright members 48 is coupled to the rectangular stanchions 45.

The framework 46 includes a top member 50 and a plurality of bottom members 52. The top member 50 is positioned to extend across a top end of the rectangular stanchions 45. The bottom members 52 are coupled between the rectangular stanchions 45. Each of the top 50 and bottom 52 members are horizontally oriented.

In use, the cage 24 is positioned in the box 12 and the concrete 14 is poured into the box 12. Each of the molds 29 is positioned on the top side 18 of the box 12 such that the shaft 42 extends through the concrete 14. Each of the molds 29 is spaced a selected distance apart from each other. Each of the molds 29 and the box 12 is removed from the concrete 14 when the concrete 14 dries. Thus, the concrete 14 is formed into a rectangular stanchion 15.

The rectangular stanchion 15 is positioned to penetrate ground. Moreover, the rectangular stanchion 15 is vertically oriented to extend upwardly from the ground. Thus, the rectangular stanchion 15 forms a fence post. The plurality of the rectangular stanchions 45 are arranged to define a perimeter of a fence. Each of the rectangular stanchions 45 is oriented such that the apertures 30 in each of the rectangular stanchions 45 face each other.

The framework 46 is attached between each of the rectangular stanchions 45. The fastener 32 is extended through the framework 46 and an associated one of the apertures 30. Thus, the framework 46 is retained on the rectangular stanchions 15. A fence 54 is attached to the top 50 and bottom 52 members of the framework 46. The concrete 14 enhances durability and a service life of the fence 54 compared to wooden fence posts.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A post molding system being configured to facilitate a concrete fence post to be molded, said system comprising:

a box configured for having concrete poured therein such that said concrete is formed in the shape of said box, wherein said box has a back wall, a top side, an interior surface and an outside surface, said top side being open such that said box is configured for having said concrete poured into said box through said top side;

a cage being positioned in said box wherein said cage is configured for reinforcing said concrete when said concrete dries in said box; and a pair of molds, each of said molds being positionable on said box wherein each of said molds is configured for forming an aperture extending through said concrete, each of said molds comprising a bracket having a central panel extending between a pair of lateral panels, said lateral panels being spaced apart from each other such that said bracket has a U-shape, said bracket having an inside surface, said inside surface corresponding to each of said lateral panels being slidable on said box while abutting said outside surface of said box, said inside surface corresponding to said central panel abutting said top side of said box.

2. The system according to claim 1, wherein said cage comprises:

a plurality of first members, and a plurality of second members, each of said second members being coupled between said first members such that said first members are spaced apart from each other, said first members being arranged to form four corners of a rectangle.

3. The system according to claim 1, further comprising a shaft being coupled to and extending away from said inside surface corresponding to said central panel, said shaft being centrally positioned between said lateral panels, said shaft having a distal end with respect to said central panel, said distal end abutting said interior surface of said back wall when said bracket is positioned on said box such that said shaft is configured to form said aperture extending through said concrete.

4. A post molding system being configured to facilitate a concrete fence post to be molded, said system comprising:

a box being configured for having concrete poured therein such that said concrete is formed in the shape of said box, said box having a back wall, a top side, an interior surface and an outside surface, said top side being open such that said is box is configured for having said concrete poured into said box through said top side;

a cage being positioned in said box wherein said cage is configured for reinforcing said concrete when said concrete dries in said box, said cage comprising:

a plurality of first members, and a plurality of second members, each of said second members being coupled between said first members such that said first members are spaced apart from each other, said first members being arranged to form four corners of a rectangle; and a pair of molds, each of said molds being positionable on said box wherein each of said molds is configured for forming an aperture extending through said concrete, each of said molds comprising:

a bracket having a central panel extending between a pair of lateral panels, said lateral panels being spaced apart from each other such that said bracket has a U-shape, said bracket having an inside surface, said inside surface corresponding to each of said lateral panels being slidable on said box while abutting said outside surface of said box, said inside surface corresponding to said central panel abutting said top side of said box, and a shaft being coupled to and extending away from said inside surface corresponding to said central panel, said shaft being centrally positioned between said lateral panels, said shaft having a distal end with respect to said central panel, said distal end abutting said interior surface of said back wall when said bracket is positioned on said box such that said shaft is configured to form said aperture extending through said concrete.

* * * * *